US005153601A

United States Patent [19]

Milne

[11] Patent Number: 5,153,601

[45] Date of Patent: Oct. 6, 1992

[54] MICROWAVE POLARIZING LENS STRUCTURE

[75] Inventor: Robert M. T. Milne, Ottawa, Canada

[73] Assignee: Her Majesty the Queen in right of Canada, as represented by the Minister of Communications, Ottawa, Canada

[21] Appl. No.: 680,514

[22] Filed: Apr. 4, 1991

[51] Int. Cl.[5] ..... H01Q 3/46

[52] U.S. Cl. ..... 343/754; 343/756; 333/21 A

[58] Field of Search ..... 343/753, 754, 756; 333/21 R, 21 A

[56] References Cited

U.S. PATENT DOCUMENTS

| | | | |
|---|---|---|---|
| 2,978,702 | 4/1961 | Pakan | 343/753 |
| 3,089,142 | 5/1963 | Wickersham, Jr. | 343/911 R |
| 3,267,480 | 8/1966 | Lerner | 343/911 R |
| 4,458,249 | 7/1984 | Valentino et al. | 343/754 |
| 4,558,324 | 12/1985 | Clapp | 343/754 |
| 4,571,591 | 2/1986 | Valentino et al. | 343/754 |
| 4,700,186 | 10/1987 | Fujino et al. | 340/825.72 |
| 4,701,917 | 10/1987 | Jones et al. | 371/15.1 |

*Primary Examiner*—Frank Gonzalez
*Attorney, Agent, or Firm*—Pascal & Associates

[57] ABSTRACT

A microwave polarizing lens structure having two concentric hemispherical arrays of metallic linear scattering elements (dipoles) supported by thin walled dielectric shells. It has the property of controlling the sense of polarization, the ellipticity ratio and shape of the radiation pattern of the antenna contained within it.

11 Claims, 4 Drawing Sheets

MICROWAVE POLARIZING LENS STRUCTURE

FIELD OF THE INVENTION

This invention relates to the field of microwave antennas and in particular to vehicle antennas used in mobile satellite communication systems.

BACKGROUND OF THE INVENTION

In mobile satellite communication systems, the satellite is circularly polarized to overcome the effects of Faraday Rotation and to simplify polarization alignment at the ground terminal. The vehicle directive antenna must track the satellite under all the dynamic conditions of the host vehicle. In the case of a system employing a geostationary satellite, the elevation angle of the satellite subtended at the vehicle is a function of the latitude of the vehicle and the position of the satellite on the geostationary orbital arc. With the satellite optimumly located, the satellite elevation angles at vehicle latitudes of 70°, 45° and 20° North are about 10°, 45° and 65° respectively. The signal strength margins in geostationary mobile satellite communication systems are relatively small, and the coverage must be sufficiently high to maintain good communications.

One such antenna is described in U.S. patent 4,700,186 issued Oct. 13th, 1987, invented by R. Milne. The antenna is elegantly simple, inexpensive to manufacture and has negligible RF loss. It generates, electronically, a number of fixed beams in azimuth and elevation and is designed to meet the requirements of mobile satellite communications systems providing regional coverage i.e. the North American continent. The antenna is however linearly polarized and there is a nominal 3 dB loss in gain when operating with a circularly polarized satellite. There is a requirement, in global mobile satellite communication systems, for higher antenna gain. A polarized lens structure has been invented that converts the linearly polarized signal radiated by the antenna to circular polarization and extends the elevation angular coverage.

DESCRIPTION OF THE PRIOR ART

U.S. Pat. No. 3,089,142 describes plural layers of wires and dipoles respectively to achieve a 90° phase shift differential and to minimize reflections. U.S. Pat. Nos. 2,978,702 and 3,267,480 describe structures that utilize a combination of multi-layer dipoles, wires or plates with different refraction coefficients to enhance the operational bandwidths. The performance of the polarizers are described in terms of refraction coefficients vs frequency or differential phase shift vs bandwidth. The polarizers must function in conjunction with antennae. The patents do not, however, address a wide range of antenna parameters of common interest, namely, non-planar geometries; the resultant radiation patterns in terms of sidelobe levels, beam width and pointing; ellipticity ratio and antenna return loss. They are essentially polarizers and do not address the potential beam shaping properties of such structures.

SUMMARY OF THE INVENTION

The present invention converts the linearly polarized signal radiated by the patented antenna design to circular polarization and extends the lower and upper limits of its elevation angular coverage. In addition, the present invention provides no RF loss and hence no increase in antenna noise temperature, no significant increase in antenna VSWR or return loss, and no significant increase in relative antenna sidelobe levels.

In the present invention a polarizing lens structure enhances the gain of the antenna contained within it. A preferred embodiment is comprised of two hemispherical arrays of metallic linear dipoles supported by thin wall dielectric shells. The length of the dipole elements, their physical separation and orientation are predetermined such as to create a differential phase shift of 90° between two equal orthogonal electric vectors radiated by the antenna.

The result is that the linearly polarized signal of the antenna is converted to circular polarization. The structure also shapes the antenna patterns in the elevation plane by controlling the net phase shift through the structure. The radial spacing between the two hemispheres is adjusted so that their reflections cancel thus reducing their effect on the antenna VSWR.

BRIEF INTRODUCTION TO THE DRAWINGS

A better understanding of the invention will be obtained by reference to the detailed description of an embodiment in conjunction with the following drawings, in which.

DETAILED DESCRIPTION OF THE INVENTION

Figure 1:
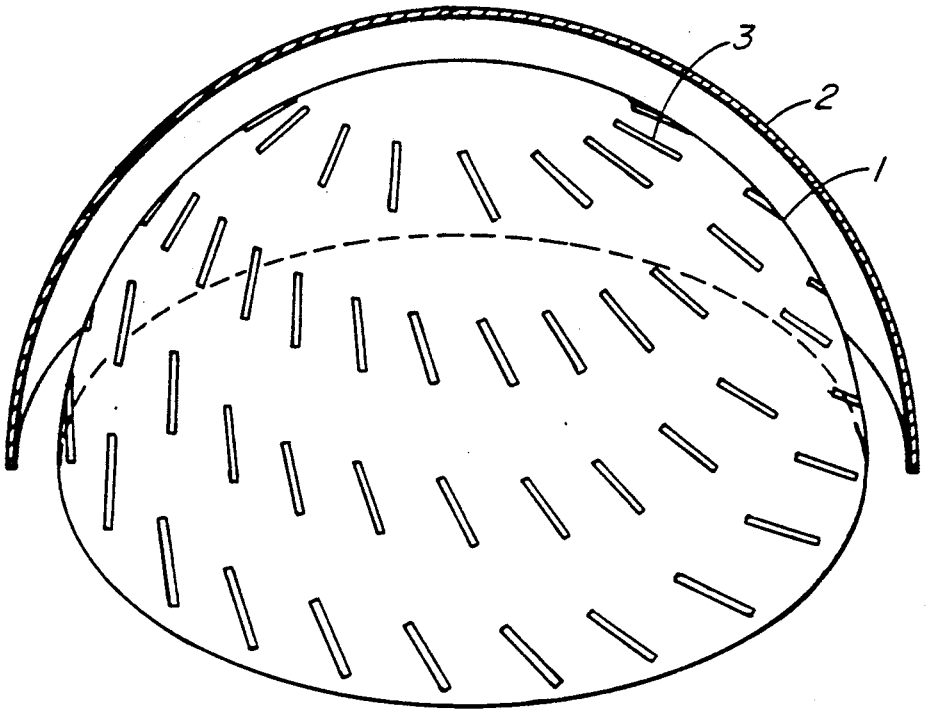
FIG. 1 is a perspective view of the invention partly in phantom.

A perspective, partly phantom view of an inner hemispherical shell 1 is shown in FIG. 1. A concentric separate overlying shell 2 is illustrated in section for ease of description. The shells can be made from dielectric materials such as ABS and PVC plastics. The thickness of the shells are sufficiently small as to introduce a relatively small phase shift ($<10°$). An array of dipole elements 3 (only a few being shown) are disposed on the surface of each shell. The separation of the arrays should be such that their reflections cancel at midband frequency thus minimizing their effect on an antenna VSWR. The dipole elements are fixed in position and orientation such as to impart a differential 90° phase shift to two equal orthogonal electric vectors of the microwave signal passing through the structure. By this means the linearly polarized signal radiated by the antenna is converted to circular polarization and the circularly polarized signal from the satellite is converted to linear polarization, thus increasing the antenna gain.

Figure 2:
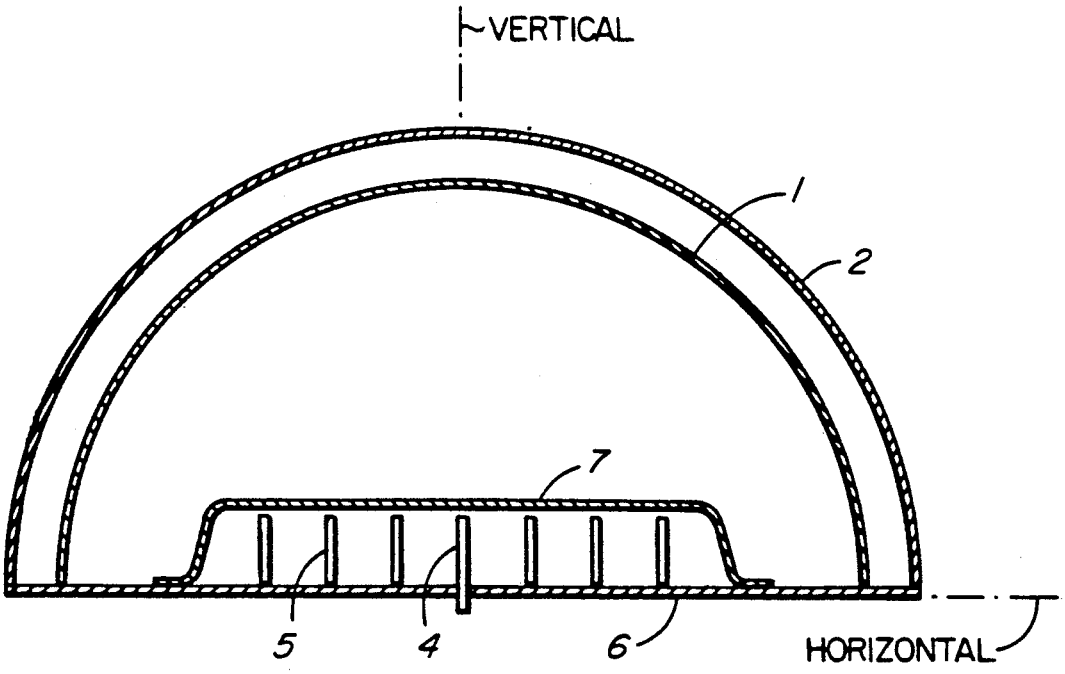
FIG. 2 is a vertical section through the antenna lens structure.

Turning now to FIG. 2, an antenna such as that described in U.S. Pat. No. 4,701,917 (although other antennas could be used) is disposed as follows. A driven element 4 and electrically enabled reflectors 5, are located above a ground plane 6 and are protected by a radome 7, as described in the aforenoted U.S. patent. The ground plane typically has a diameter of between 2 and 4 wavelengths and the antenna is contained within the polarizing lens structure described above.

Figure 3:
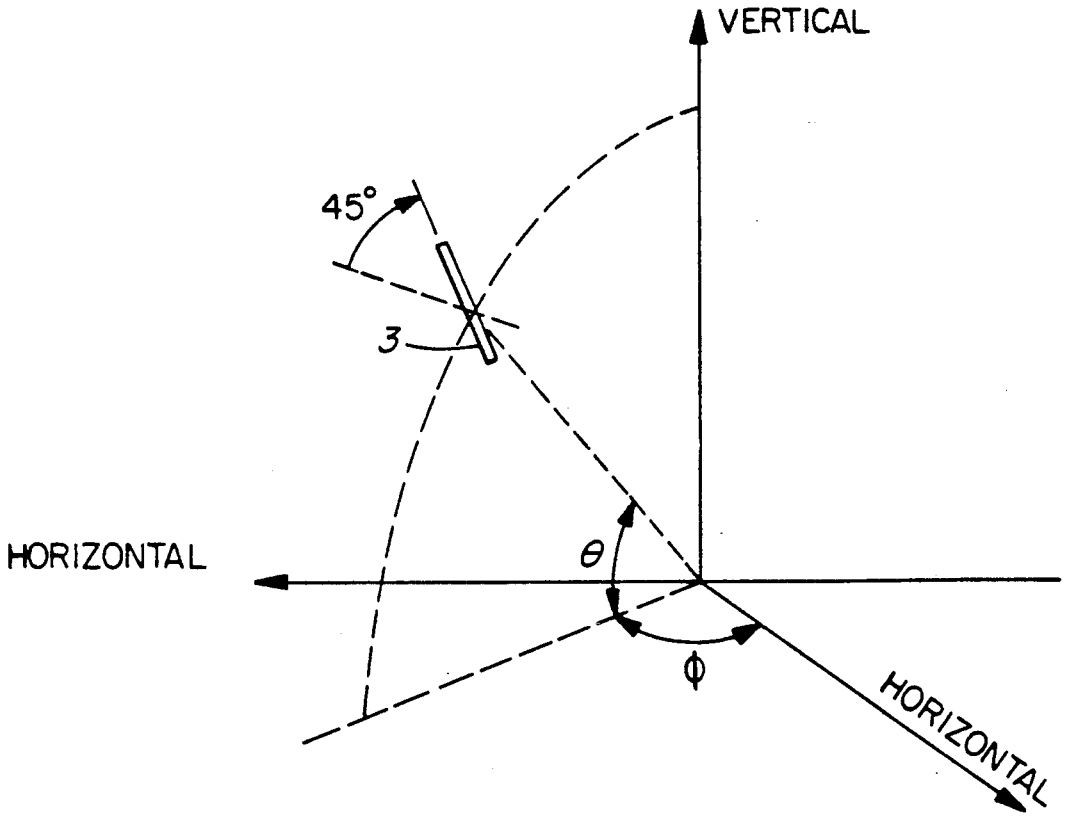
FIG. 3 illustrates the co-ordinate system referred to in the detailed description of the invention.

The theory of operation will now be described using the co-ordinate system of FIG. 3. The differential phase shift through the arrays is a function of dipole element length, width and spacing. Each hemispherical array produces a nominal differential phase shift of 45° at midband frequency resulting in a total differential phase shift of 90°. To achieve the required differential phase shift, the dipole elements are inclined at 45° relative to a local line of longitude (see FIG. 3). The required locus to achieve this condition is given by $$\phi = \log_e(\tan(\theta/2 + \pi/4))$$

where $\phi$ and $\theta$ are the angular position of the dipole element in azimuth and elevation respectively. Because the polarizing structure is a curved surface and lies within the Near Field of the antenna contained with it, the relative improvement in gain is limited to about 2 dB. The preferred length and width of the dipole elements are $\frac{1}{3}$ and 1/40 wavelengths respectively. The thickness of the dielectric shells is less than 1/60 wavelength. In one successful embodiment, the array of elements was generated by incrementing the locus by 22.5° in azimuth generating a total of 16 locii. Four rows of dipole elements were generated centered at $\theta = 10$, 30, 50 and 70° respectively. To maintain the same nominal physical separation between elements at $\theta = 70°$ only 8 dipole elements were used spaced every 45° in azimuth.

It is important that the reflections from the dipole arrays do not significantly affect the sidelobe levels and return loss of the antenna. To achieve low reflections, the arrays are separated by $\frac{1}{8}$ wavelengths. The reflections from each array substantially cancel.

Figure 4:
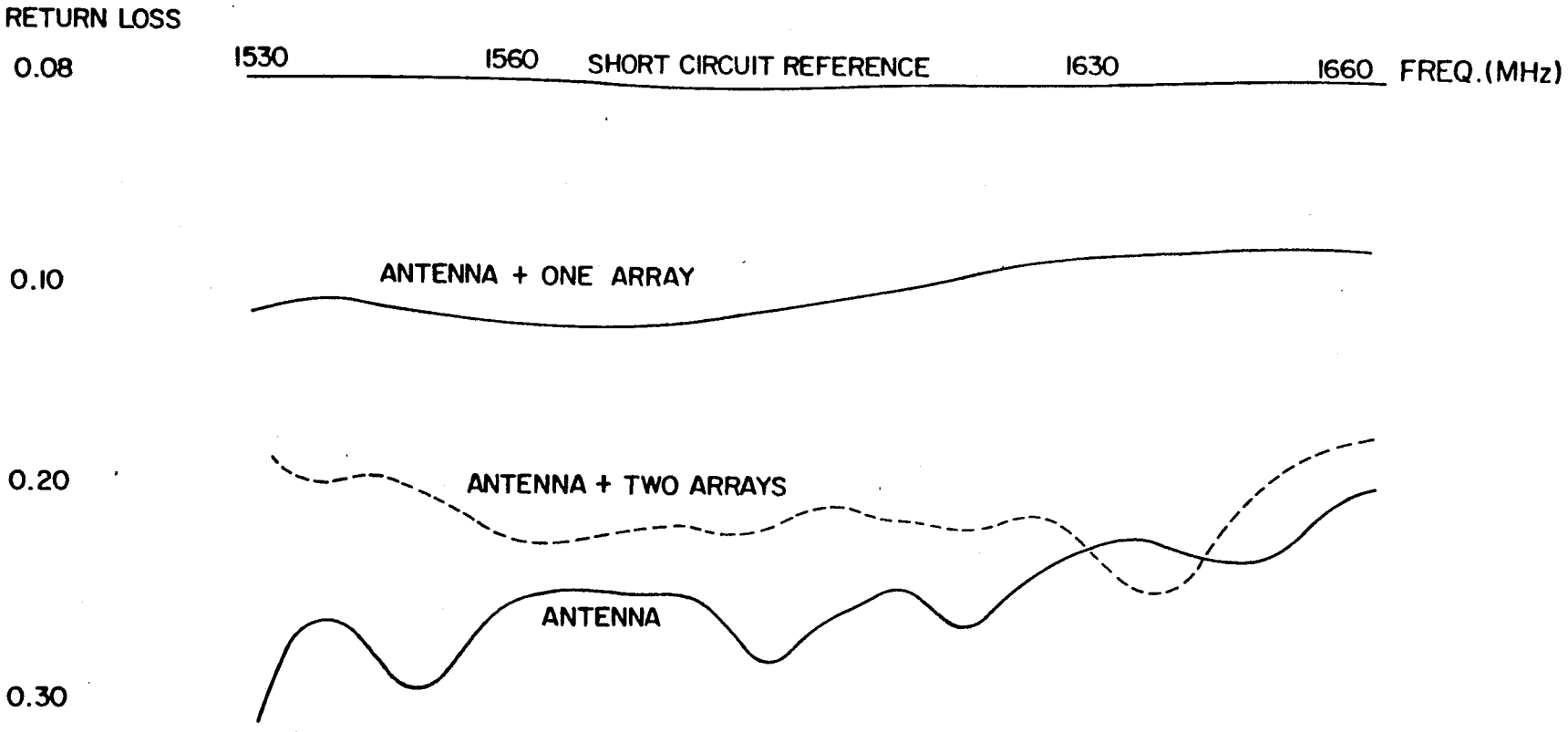
FIG. 4 are graphs showing the effects of the polarizing lens structure on the antenna return loss.

FIG. 4 are graphs of antenna return loss for the antenna described in the aforenoted U.S. patent in combination with the dipole element array structures. Graphs of antenna return loss for the antenna itself, a short circuit reference, the antenna plus one array, and the antenna plus two arrays are illustrated. It can be seen that there is a significant increase in return loss when one array is added. By adding the second array the reflections cancel and the return loss is only slightly greater than the antenna itself.

The antenna described in the aforenoted U.S. patent has two design limitations. Because of the fundamental limitations of the antenna radiating elements, the antenna gain drops off rapidly above 65° elevation and is zero at 90° elevation. Between 30° elevation and 0° elevation there is also a 6 db reduction in gain because of the finite size of the antenna ground plane. It is desirable to enhance the gain in these regions to extend the operational elevation angular coverage.

It is possible to enhance the gain at the expense of some increase in ellipticity ratio of the circularly polarized signal. Antenna gain is relatively insensitive to ellipticity ratio. A 6 dB ellipticity ratio would result in a loss of gain of only 0.5 dB. A perfect polarizer with 0 dB ellipticity ratio introduces a net phase shift of −45° i.e. the mean of −90° and 0°. By controlling the net phase shift through the structure it is possible to extend the upper and lower limits of elevation angular coverage.

Figure 5:
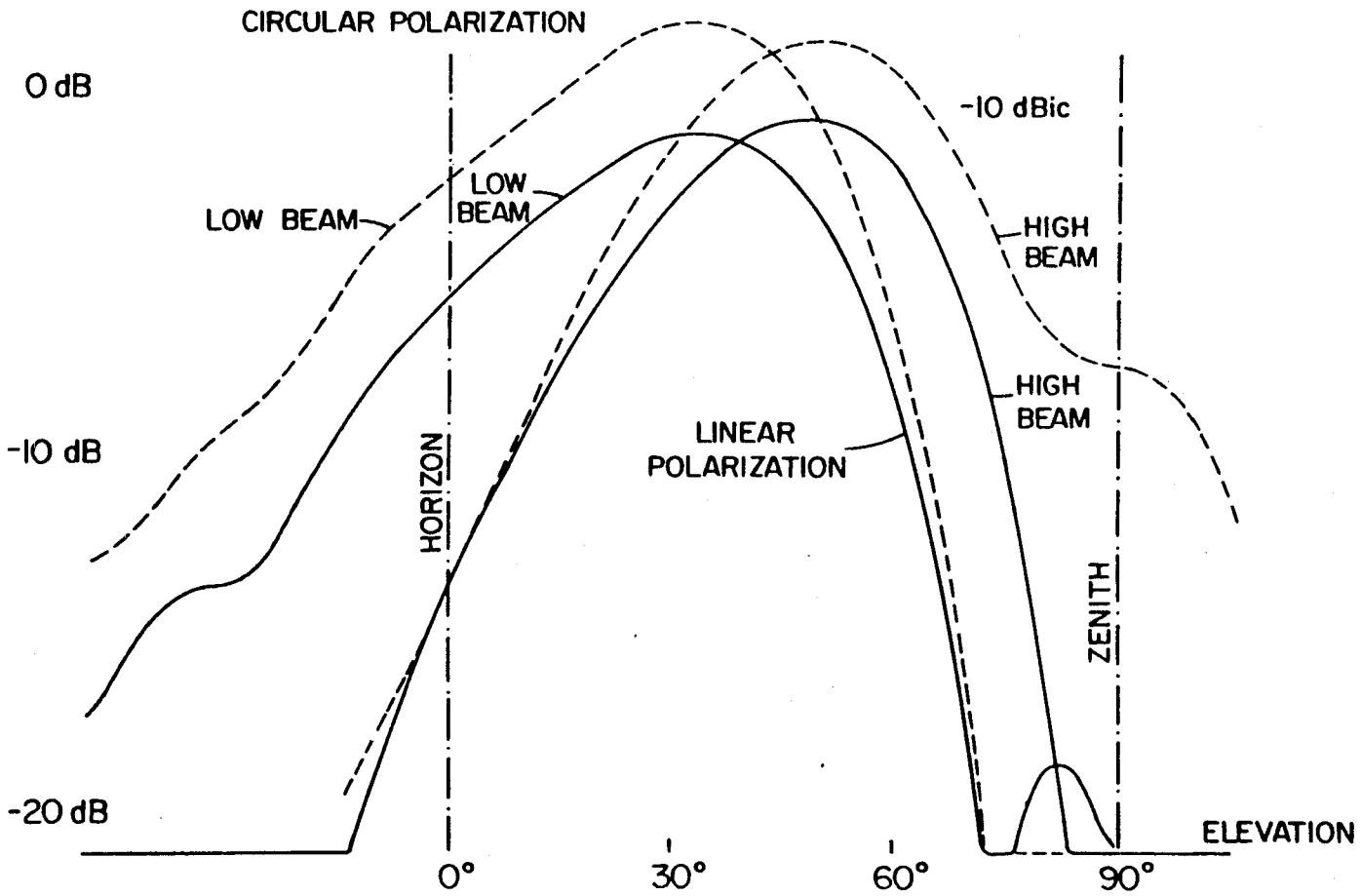
FIG. 5 are graphs showing the effect of the polarizing lens structure on antenna gain and elevation angular coverage.

FIG. 5 shows the low and high elevation beams of a linearly polarized antenna and the resulting patterns when the polarized lens structure is added. At 70° elevation an improvement of 4 dB in antenna gain is realized which is about 2 dB higher than can be achieved by polarization alone. At 0° elevation the improvement in gain is 3.5 dB. Because of the limitations in polarizer design and the boundary conditions imposed by the ground plane, about 2 dB of the improvement can be attributed to beam shaping alone.

It should be noted that the invention is not restricted to hemispherical shells, and as long as the general design criteria are maintained, shells of elliptical, cylindrical and conical cross-sections can also be used. The invention can significantly enhance the antenna gain of the linearly polarized antenna design and extend its elevation angular coverage. As the downlink system margins i.e. from satellite to ground terminal, are more critical than the uplink i.e. from ground terminal to satellite, the polarizing structure is optimized for the downlink frequencies, i.e. 1530–1560 MHz.

A person understanding this invention may now conceive of alternative structures and embodiments or variations of the above. All of those which fall within the scope of the claims appended hereto are considered to be part of the present invention.

I claim:

1. A microwave polarizing lens structure comprising two concentric separate arrays of linear metal dipole elements, the arrays being separated by a distance such that their reflections cancel at midband frequency, the dipole elements each having a length, separation and orientation as to impart a nominal 90° differential phase shift to two orthogonal vectors of a microwave signal passing through the structure and to impart a net phase shift such as to modify the transmission characteristics in the planes passing through the axis of symmetry.

2. A polarizing lens structure as defined in claim 1 in which the arrays are fixed to and are supported by dielectric shells, each having a thickness of less than about $\lambda/60$.

3. A polarizing lens structure as defined in claim 2 in which each of said shells is hemispheric in shape.

4. A polarizing lens structure as defined in claim 2, in which each dipole element is inclined by 45° relative to a local line of longitude.

5. A polarizing lens structure as defined in claim 4, in which the locus of each dipole element is determined by the equation $$\phi = \log_e(\tan(\theta/2 + \pi/4))$$

where $\phi$ is the angular position in radians of the dipole element in azimuth, and $\phi$ is the angular position in radians of the dipole element in elevation.

6. A lens structure as defined in claim 4 in in which the arrays are separated by about $\lambda/8$.

7. A polarizing lens structure as defined in one of claims 2-6 and further comprising an adaptive array antenna having a driven monopole disposed along a central axis of said shells and a ground plane having a diameter of about 2–4 wavelengths disposed in a plane normal to the central axis of the said shells and located below the said monopole.

8. A polarizing lens structure as defined in claim 2, in which the shells are ellipsoids.

9. A polarizing lens structure as defined in claim 2 in which the shells are conical or truncated conical in shape.

10. A polarizing lens structure as defined in claim 2 in which the shells are concentric cylinders.

11. A polarizing lens structure as defined in claim 2. in which the length of each dipole element is about $\lambda/3$ and the width of each dipole element is about $\lambda/40$.

* * * * *